United States Patent [19]

Tanahashi

[11] 4,278,967

[45] Jul. 14, 1981

[54] WIRELESS DETECTION AND WARNING SYSTEM

[76] Inventor: Fumitaka Tanahashi, 29-23, Kounan 3-chome, Kounan-ku, Yokohama-shi, Kanagawa-ken, Japan

[21] Appl. No.: 82,584

[22] Filed: Oct. 9, 1979

[51] Int. Cl.[3] ..... G08B 21/00

[52] U.S. Cl. ..... 340/539; 340/545

[58] Field of Search ..... 340/517, 521, 541, 539, 340/545

[56] References Cited

U.S. PATENT DOCUMENTS

| | | | |
|---|---|---|---|
| 4,101,872 | 7/1978 | Pappas | 340/539 |
| 4,101,873 | 7/1978 | Anderson et al. | 340/539 |
| 4,160,246 | 7/1979 | Martin et al. | 340/539 |

*Primary Examiner*—Alvin H. Waring

*Attorney, Agent, or Firm*—Wenderoth, Lind & Ponack

[57] ABSTRACT

A warning device having a sensing signal transmitting unit which includes a sensing element which operates when, for example, a door under observation is opened, and a receiving unit which produces a warning in response to the transmitted signal.

1 Claim, 5 Drawing Figures

WIRELESS DETECTION AND WARNING SYSTEM

BACKGROUND AND SUMMARY OF THE INVENTION

The present invention relates to a warning device. More particularly, it relates to a warning device comprising one or more sensing signal transmitting units and a single receiving unit electrically connected therewith wherein a sensor connected with the transmitting unit generates a sensing signal when, for example, a door under observation is opened, and the signal is transmitted to the receiving unit to provide a warning.

In particular, the warning device of the present invention comprises at least one sensing signal transmitting unit and a single receiving unit.

The transmitting unit includes a sensor which provides a sensing signal of a predetermined low frequency when, for example, a door under observation is opened. The transmitting unit further includes a low frequency oscillation portion which provides a low frequency signal in response to the sensing signal. The portion may be, for example, a resonance element. The low frequency signal is then frequency-multiplied and modulated to a high frequency signal by a modulation portion. A high frequency oscillation portion transmits the high frequency signal through a transmitting antenna.

The receiving unit in turn includes a receiving antenna to receive the high frequency signal from the transmitting unit, a frequency modulation portion which amplifies selectively the high frequency signal to an intermediate frequency signal, an intermediate frequency amplifying circuit which amplifies the signal, a detection circuit which detects a signal having the same frequency as that of the resonance frequency of the low frequency oscillation portion in the transmitting unit, a low frequency amplifying portion which receives the signal of the resonance frequency through a coupling condensor, a selection circuit which selects the output of the low frequency amplifying portion by, for example, the same resonance element as that in the transmitting unit, a low frequency amplifying circuit which amplifies the output signal of the selection circuit, a voltage doubler rectifying circuit which rectifies the output signal of the low frequency amplifying circuit to a direct current, and a driving circuit for warning which operates in response to a d.c. voltage resulting from the direct current.

BRIEF DESCRIPTION OF THE DRAWINGS

The other features and the objects of the present invention will be apparent from the following description of preferred embodiments thereof in connection with the drawings attached hereto: in which.

DESCRIPTION OF THE PREFERRED EMBODIMENT

Figure 1:
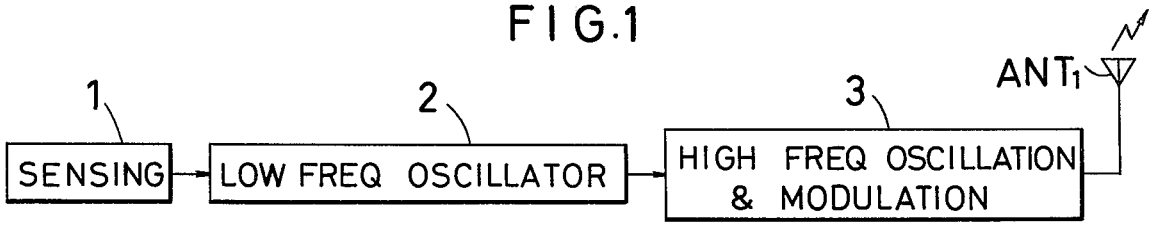
FIG. 1 shows a block diagram of a sensing signal transmitting unit of the warning device of the invention.

First referring to FIG. 1 which illustrates a block diagram of the sensing signal transmitting unit, the unit comprises a sensing portion 1, a low frequency oscillation portion 2, a high frequency oscillation portion and modulation portion 3, and a transmitting antenna $ANT_1$.

Figure 3:
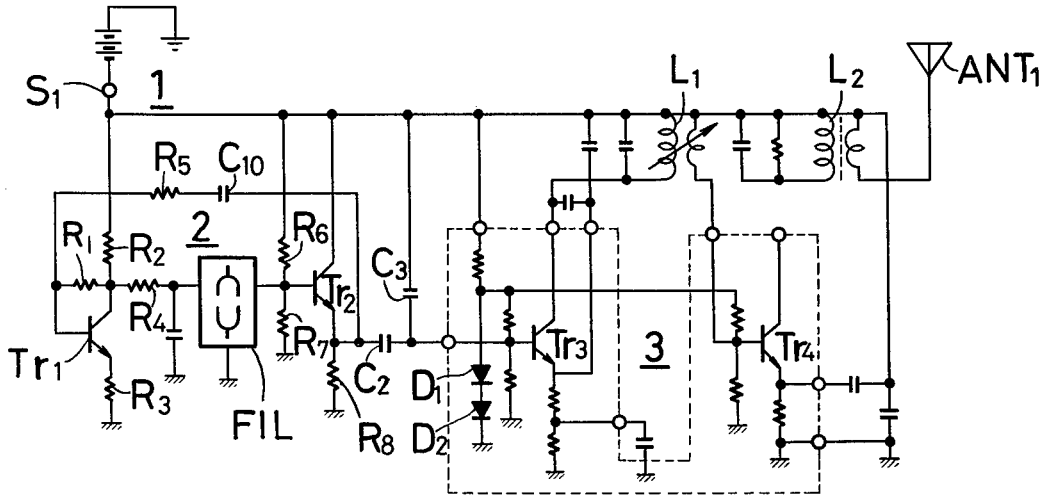
FIG. 3 shows an embodiment of a circuit arrangement of the transmitting unit of FIG. 1.

FIG. 3 shows an embodiment of a circuit arrangement of the transmitting unit of FIG. 1, in which the sensing portion 1 has a sensor $S_1$. When the sensor closes, the whole unit turns on, and a d.c. voltage is applied to an input terminal of a tuning fork filter FIL through resistors $R_2$ and $R_4$, thereby causing a slight oscillation of the filter. The oscillation frequency of the filter is then amplified by an amplifying portion which comprises a transistor $Tr_2$ and resistors $R_6$, $R_7$ and $R_8$, and is positively fed back to the base of a transistor $Tr_1$ through a resistor $R_5$ and a condensor $C_{10}$. The fed back signal is further amplified in an amplifying portion which comprises the transistor $Tr_1$ and resistors $R_1$, $R_2$ and $R_3$. The amplified signal enters again the filter. With the repetition of the above operations, the output of the transistor $Tr_2$ increases.

The output of the transistor $Tr_2$ is given to the base of a transistor $Tr_3$ to produce a modulated signal. The signal is multiplied and modulated to a high frequency signal in a multiplying and modulation portion. A high frequency oscillation portion, including transistors $Tr_3$ and $Tr_4$, transmits the high frequency signal through the transmitting antenna $ANT_1$. Diodes $D_1$ and $D_2$ are for bias stabilization. $C_2$ and $C_3$ are coupling condensors, and $L_1$ and $L_2$ are for stabilization of the circuit configurations involved.

Figure 2:
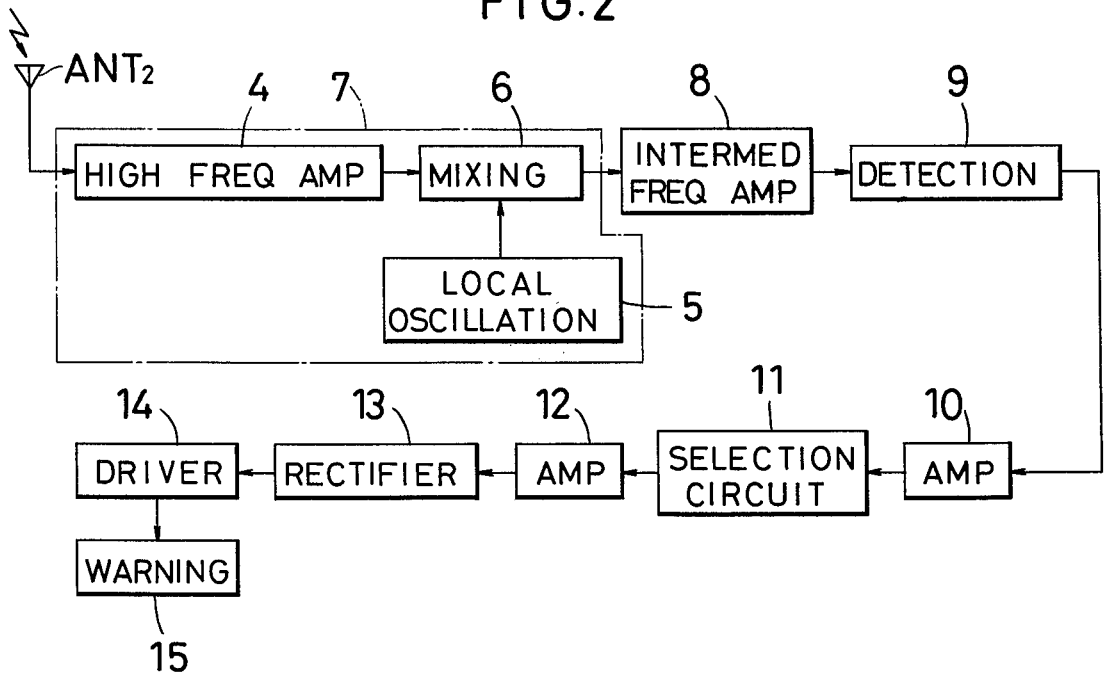
FIG. 2 shows a block diagram of a receiving unit of the warning device of the invention.

FIG. 2 illustrates a block diagram of the receiving unit. The unit comprises a receiving antenna $ANT_2$, an FM end portion 7 including a high frequency amplifying portion 4, a local oscillation portion 5 and a mixing portion 6, an intermediate frequency amplifying portion 8, a detection circuit 9, an amplifying portion 10, a selection circuit 11, an amplifying portion 12, a rectifying portion 13, a driving portion 14, and a warning portion 15.

Figure 4:
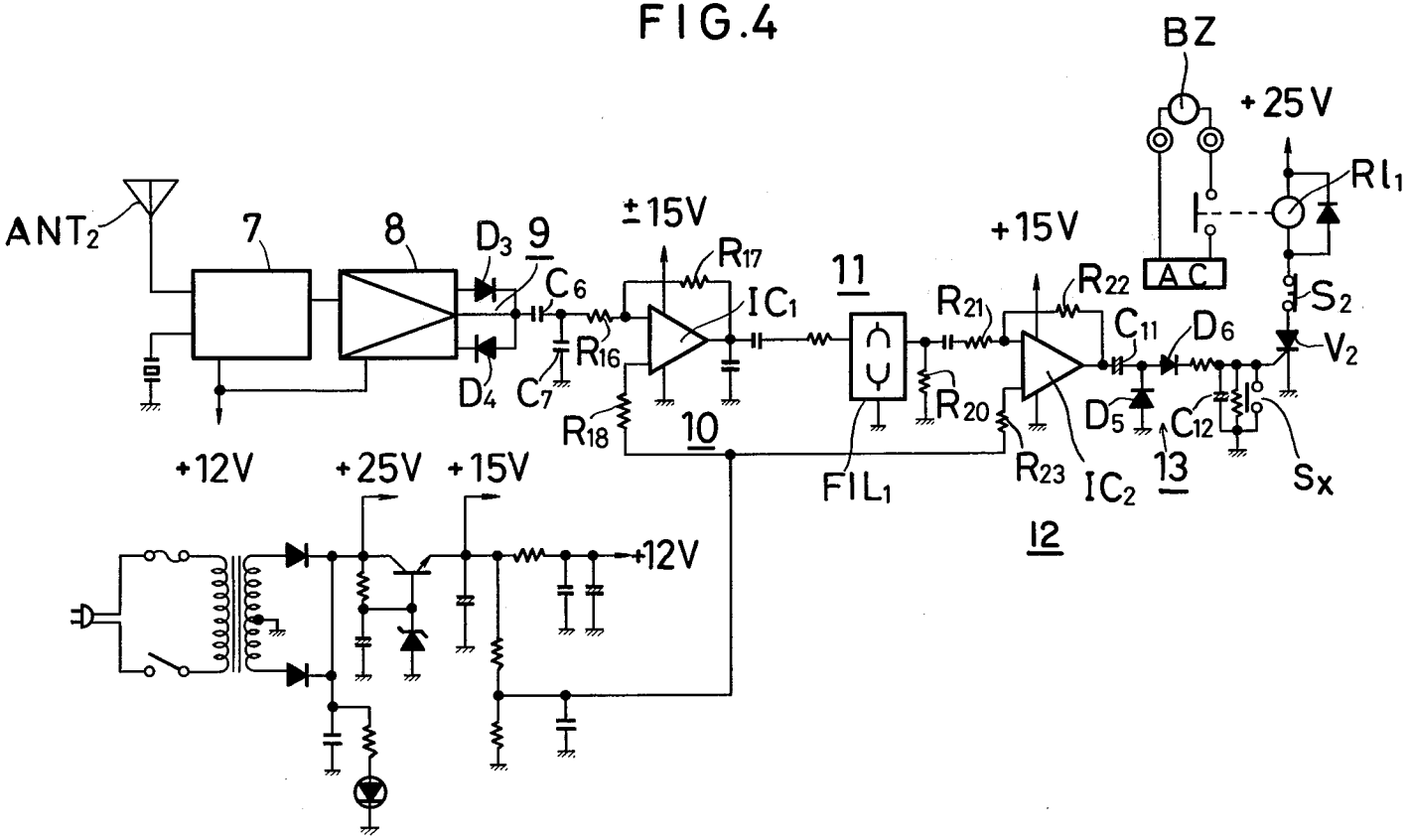
FIG. 4 shows an embodiment of a circuit arrangement of the receiving unit of FIG. 2.

As shown in FIG. 4, the signal from the transmitting unit is received by the receiving antenna $ANT_2$, and then by the FM front end portion 7. The FM portion 7 amplifies the signal selectively to an intermediate frequency signal. The signal is then selectively amplified by an intermediate frequency amplifying portion 8, and enters a detection circuit 9 which includes diodes $D_3$ and $D_4$.

The thus detected signal is a signal of the same frequency as the resonance frequency of the filter FIL, and enters a low frequency amplifying portion 10 which comprises an amplifying circuit $IC_1$ and resistors $R_{16}$, $R_{17}$ and $R_{18}$, through a coupling condensor $C_6$, thus providing an input signal to a tuning fork filter $FIL_1$ in the selection circuit 11.

The filter $FIL_1$ has the same resonance frequency as that of the filter FIL in the transmitting unit so as to oscillate at that frequency only, to thereby select the desired signal.

The selected signal is amplified in a low frequency amplifying portion 12 which comprises an amplifying circuit $IC_2$, resistors $R_{21}$, $R_{22}$ and $R_{23}$, and then is converted into a direct current in a voltage doubling rectifying circuit 13 which comprises diodes $D_5$ and $D_6$, and condensors $C_{11}$ and $C_{12}$. Switch contact Sx is provided to selectively disable the receiving unit by shorting the rectified selected d.c. voltage signal to ground. The thus produced d.c. voltage produces a gate voltage of an SCR $V_2$, thereby causing the SCR to conduction. Upon the conduct of the SCR $V_2$, a relay $R1_1$ is activated to close its contacts, thereby causing a buzzer BZ to generate a warning.

According to the present invention, as is apparent, even when the sensor is restored to its original position, the warning continues on account of the operation of the SCR. The warning stops by the pushing a reset switch $S_2$ after restoring the sensing portion to its original state. Furthermore, according to the present invention, a self-restoring warning device is obtainable by the use of a transistor circuit arrangement including a timer means arranged so as to operate the reset switch $S_2$.

Figure 5:
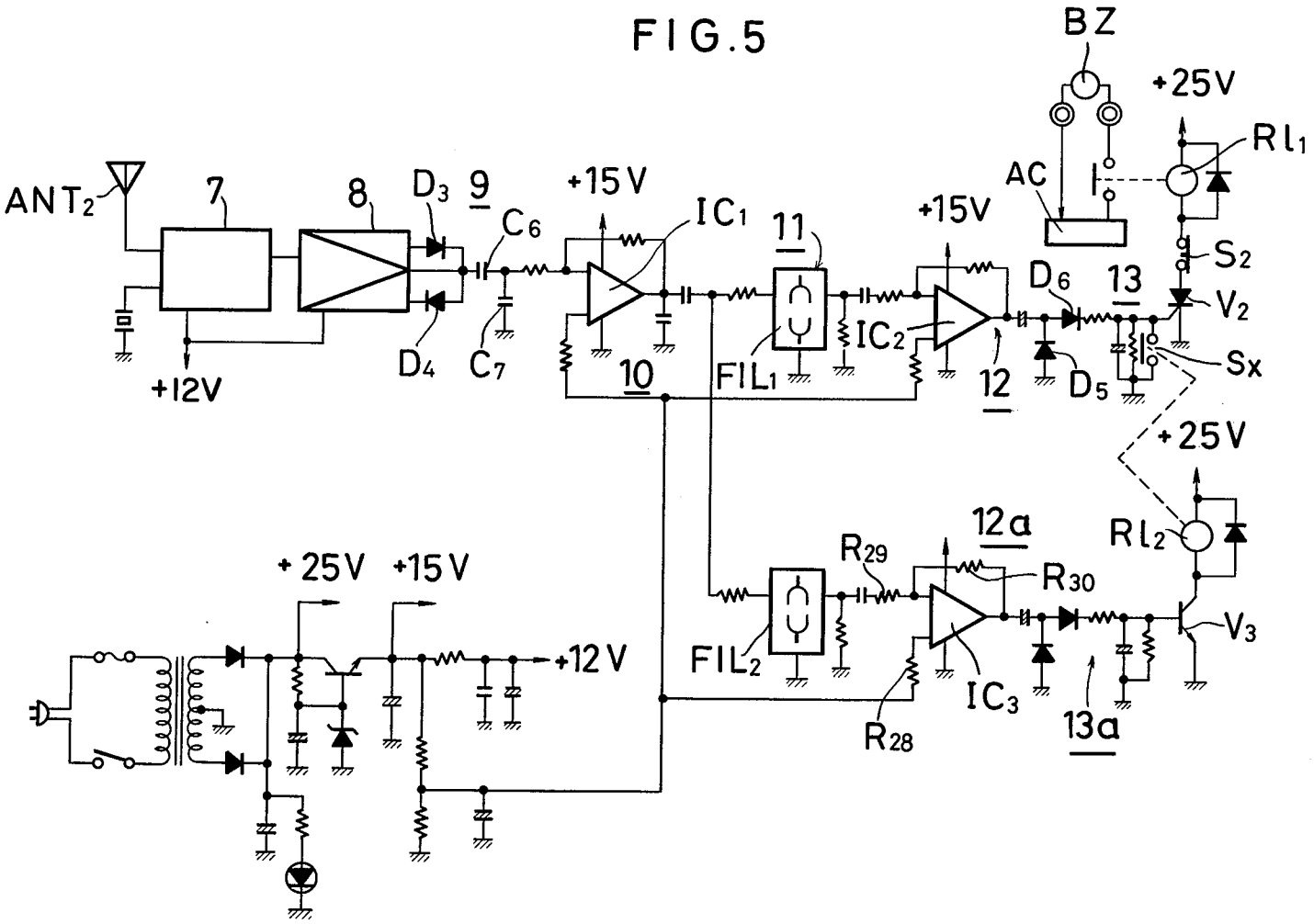
FIG. 5 shows a further embodiment of a circuit arrangement of a receiving unit of the warning device of the invention.

According to the present invention, there is further provided a warning device which is so designed as not to generate a warning signal needlessly. The warning device further comprises, in addition to the sensing signal transmitting unit as is above stated, at least one portable transmitting unit and at least one modified receiving unit. The portable unit has the same construction as that of the transmitting unit previously described except with regard to the sensor S. The portable unit has a hand-operated switch in place of the sensor. The modified receiving unit, (as illustrated in FIG. 5), further includes, in addition to the construction previously described, a tuning fork filter $FIL_2$, a low frequency amplifying portion 12*a* including an amplifying circuit $IC_3$ and resistors $R_{28}$, $R_{29}$ and $R_{30}$, and a rectfying circuit 13*a*, with the filter $FIL_2$ tuned to the same resonance frequency as that of the portable transmitting unit filter and connected with the filter $FIL_1$ in parallel and having a resonance frequency ratio of 2:1. The second relay $R1_2$ is arranged to operate the switch contact Sx when activated by transistor $V_3$. The warning device, comprising the sensing signal transmitting unit, the portable transmitting unit and the modified receiving unit, is used when a needless warning should be avoided. That is, the portable unit is turned on by a carrier when he opens a door to disable the warning unit. Each of a plurality of carriers may have each portable unit.

As has been set forth above, since the warning device of the present invention operates through electric waves, there is no need of connecting the units with each other by wires. Also, the sensing signal transmitting units may be provided at any desired number of places to be observed since the units can have the same tuning fork filter oscillating at a single frequency so as to operate the single receiving unit. The warning device of the invention has a further advantage in that any type of sensing element can be used, that is, either a contacting type or non-contacting type. Furthermore, the device has an excellent selectivity for signals since it has a resonance element, and is thus capable of avoiding erroneous operation.

According to the modified device of the invention, the warning operation is effected by electric waves, and if necessary, the device can be made inoperative by a similar operation. If desired, the device can be connected to remote buzzers, etc, by telephone circuits.

What is claimed is:

1. A wireless warning and detection system comprising at least one sensor type transmitting unit, a receiving unit, and at least one portable transmitting unit;

said at least one sensor type transmitting unit comprising:

a sensor element for producing a sensing signal in response to the detection of an operation to be detected by said sensor;

a low frequency oscillation means operatively connected to said sensor element for producing a low frequency signal in response in said sensing signal;

a modulation means operatively connected to said low frequency oscillation means for multiplying and modulating said low frequency signal to produce a high frequency signal;

a high frequency transmitting means operatively connected to said modulation means for transmitting said high frequency signal through a transmitting antenna;

said at least one portable transmitting unit comprising:

a switch means for producing a control signal;

an additional low frequency oscillation means operatively connected to said switching means for producing an additional low frequency signal in response to said control signal;

an additional modulation means operatively connected to said additional low frequency oscillation means for multiplying and modulating said additional low frequency signal into an additional high frequency signal;

an additional high frequency transmitting means operatively connected to said additional modulation means for transmitting said additional high frequency signal through an additional transmitting antenna, wherein the frequency of said low frequency signal is different than the frequency of said additional low frequency signal;

said receiving means comprising:

a frequency modulation means for receiving said high frequency signal and said additional high frequency signal through a receiving antenna and for amplifying said signals selectively to intermediate and additional intermediate frequency signals;

an intermediate frequency amplifying means operatively connected to said frequency modulation means for amplifying said intermediate and said additional intermediate frequency signals;

a detection means operatively connected to said intermediate frequency amplifying means for providing a signal having the same frequency as that of said low frequency signal and for providing a signal having the same frequency as that of said additional low frequency signal;

a low frequency amplifying means operatively connected to said detection means for amplifying said signal and said additional signal from said detection means;

first and second selection circuit means operatively connected to said low frequency amplifying means, said first selection means providing a warning in response to the detection of said signal having the same frequency as that of said low frequency oscillation means and said second selection means providing an inhibit signal upon the detection of a signal having the same frequency as that of said additional low frequency oscillation means;

wherein said second selection means is operatively connected to said first selection means and wherein said inhibit signal of said second selection means inhibits the operation of said first selection means whereby the operation of the switch means on said at least one portable transmitting unit disables at least a portion of said receiving unit to prevent the operation of said warning means.

* * * * *